US008861994B2

(12) United States Patent
Ishii

(10) Patent No.: US 8,861,994 B2
(45) Date of Patent: Oct. 14, 2014

(54) IMAGE FORMING APPARATUS AND TONER SUPPLY CONTROL METHOD

(71) Applicant: Hiroki Ishii, Kanagawa (JP)

(72) Inventor: Hiroki Ishii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 118 days.

(21) Appl. No.: 13/710,991

(22) Filed: Dec. 11, 2012

(65) Prior Publication Data

US 2013/0230332 A1 Sep. 5, 2013

(30) Foreign Application Priority Data

Mar. 5, 2012 (JP) ..... 2012-047999

(51) Int. Cl.
*G03G 15/08* (2006.01)
*G03G 15/00* (2006.01)

(52) U.S. Cl.
CPC ..... *G03G 15/0832* (2013.01); *G03G 15/556* (2013.01)
USPC ..... 399/27; 399/58; 399/257; 399/258

(58) Field of Classification Search
USPC ..... 399/27, 58–60, 62, 258, 259
See application file for complete search history.

(56) References Cited

U.S. PATENT DOCUMENTS

| | | | | |
|---|---|---|---|---|
| 7,013,093 | B2 * | 3/2006 | Nakazato | 399/27 |
| 7,095,966 | B2 * | 8/2006 | Adachi | 399/27 |
| 2006/0002724 | A1 | 1/2006 | Fujimori et al. | |
| 2007/0065164 | A1 | 3/2007 | Fujimori et al. | |

FOREIGN PATENT DOCUMENTS

| | | |
|---|---|---|
| JP | 4-158382 | 6/1992 |
| JP | 2000-075576 | 3/2000 |
| JP | 2006-047965 | 2/2006 |
| JP | 2007-079429 | 3/2007 |
| JP | 2010-008931 | 1/2010 |

* cited by examiner

*Primary Examiner* — Hoang Ngo
(74) *Attorney, Agent, or Firm* — Harness, Dickey & Pierce, P.L.C.

(57) ABSTRACT

An image forming apparatus includes a forced toner consumption controller which executes a forced toner consumption control; a toner supply controller which executes a toner supply control; and a pre-job controller which, upon receipt of an image forming job, and before the start of the job, acquires a toner consumption index value, determines a specific target image density based on the acquired index value, executes a previous toner consumption and supply control including the forced toner consumption control and the toner supply control that makes a toner concentration in a developer of a development device subjected to the forced toner consumption control approach a specific target toner concentration, and then executes a previous image density adjustment control that adjusts one or more image forming conditions to make an image density after the previous toner consumption and supply control approach the specific target image density.

11 Claims, 7 Drawing Sheets

IMAGE FORMING APPARATUS AND TONER SUPPLY CONTROL METHOD

CROSS-REFERENCE TO RELATED APPLICATION

This patent application is based on and claims priority pursuant to 35 U.S.C. §119 to Japanese Patent Application No. 2012-047999, filed on Mar. 5, 2012 in the Japan Patent Office, the entire disclosure of which is hereby incorporated by reference herein.

BACKGROUND OF THE INVENTION

1. Field of the Invention

The present invention relates to an image forming apparatus, such as a copier, a printer, or a facsimile machine, and more specifically to an image forming apparatus which forms an image with a two-component developer including toner and carrier, and to a toner supply control method for the image forming apparatus.

2. Description of the Related Art

In an electrophotographic image forming apparatus, upon receipt of an input of an image forming job, such as a print job, a latent image carrier is driven to rotate and an outer circumferential surface of the rotating latent image carrier is uniformly charged to a target charge electric potential. Thereafter, the outer circumferential surface of the latent image carrier is exposed to light according to image information, thereby forming an electrostatic latent image on the outer circumferential surface of the latent image carrier. Then, due to a development potential, i.e., a potential difference between the electrostatic latent image on the latent image carrier and an outer circumferential surface of a developer carrier, the toner in the two-component developer (hereinafter simply referred to as the developer) on the developer carrier electrostatically adheres to the electrostatic latent image, thereby developing the electrostatic latent image into a toner image. The toner image on the latent image carrier formed by the development process is ultimately transferred onto a recording medium, thereby forming an image thereon. In such an image forming apparatus, a change in temperature or humidity, or deterioration over time of the developer, causes a change in toner charge in the developer, resulting in a change in development γ (gamma). As illustrated in FIG. 1, the development γ corresponds to the slope of a straight line representing the relationship between the development potential and the toner adhesion amount per unit area of the electrostatic latent image, i.e., per unit latent image area.

The development γ may be detected by the following method: That is, predetermined electrostatic latent images (i.e., latent patterns for image density adjustment) are first developed with different development potentials to form toner images (i.e., toner patterns for image density adjustment). Then, respective toner adhesion amounts of the toner images are detected by a toner adhesion amount sensor, and the slope of a straight line representing the relationship between the development potential and the toner adhesion amount based on the detection results is the development γ.

If the development γ changes, toner images resulting from electrostatic latent images developed with the same development potential have different toner adhesion amounts, and thus have different image densities. Further, in a color image formed by toner images of a plurality of colors superimposed upon one another, respective image densities of the colors individually change, and thus color reproducibility deteriorates.

Accordingly, the image forming apparatus may be configured to execute a process control, i.e., an image density adjustment control involving detecting the development γ at predetermined intervals, such as at every formation of a predetermined number of images, for example, and adjusting one or more development conditions, such as a target charge potential of the latent image carrier, a development voltage applied to the developer carrier, or exposure power used in the latent image forming process, to obtain a target image density.

Further, in the image forming apparatus using a two-component developer including toner and carrier, if the toner concentration in the developer is not appropriately controlled, the target image density is not obtained. Normally, therefore, the toner concentration in the developer of a development device is detected as appropriate, and supply of toner to the development device is controlled such that the detected toner concentration approaches the target toner concentration.

If the development γ is substantially changed in the image forming apparatus which executes the image density adjustment control, the above-described adjustment of the development condition by itself may still result in degraded image quality. For example, if the development condition is adjusted by the image density adjustment control in accordance with the substantially changed development γ, the development potential may be excessively reduced. In this case, if the image forming apparatus executes an image gradation control by changing the exposure power, defective gradation is caused. Conversely, if the development potential is excessively increased by the image density adjustment control, the development voltage needs to be increased beyond what a development power source may be able to supply unless a high-capacity power source is provided, which increases the cost. Moreover, if the development potential is excessively increased by the image density adjustment control, adhesive force of the toner adhering to the outer circumferential surface of the latent image carrier is increased by a relatively strong electric field in the development process, resulting in a transfer failure.

In the above-described process control performed by the image forming apparatus, as well as the adjustment of the development condition, a process of adjusting the target toner concentration is also executed if the development γ substantially deviates from a target value even when the toner concentration is adjusted to the target toner concentration. For example, if the development γ is smaller than the target value by 0.3 $mg/cm^2 \cdot V$ even when the toner concentration is adjusted to a target toner concentration of 5 wt %, a process of adjusting the target toner concentration to 7 wt % is executed. With this control, it is possible to obtain the target image density by changing the toner concentration while adjusting the development potential within a range not causing the above-described undesirable phenomena.

As well as the above-described image density adjustment control, a forced toner consumption control involving forcibly consuming depleted toner in the development device and replacing the depleted toner with new toner may be executed as one way to adjust the image density. In this case, toner consumption control is executed to replace the depleted toner in the development device with new toner, thereby preventing the shortage of the toner charge and providing the target image density. Normally, toner remaining for a relatively long time in the development device without being used in the development process is continuously affected by a developer mixing operation performed in the development device, and thereby gradually deteriorates and suffers degraded charging performance. If the proportion of such depleted toner in the development device is increased, insufficiently charged toner is also increased. As a result, the toner adhesion amount per unit latent image area is excessively increased, and an image density higher than the target image density is obtained.

In the foregoing image forming apparatus, which changes the target toner concentration to adjust the image density, if the print job has a substantial change in, for example, a toner consumption index value, such as the image area ratio of images to be formed, the image density or color reproducibility of the post-change image may be degraded.

As a specific example, in a print job of continuously forming images having a relatively low image area ratio (e.g., approximately 1%), the toner consumption by image formation is relatively small. Therefore, a relatively large amount of toner unused in the development process remains in the development device, as a result of which overcharged toner continuously affected by the mixing operation and having a toner charge larger than usual is increased in the development device. In this case, the image density is reduced. Therefore, a control of increasing the target toner concentration to increase the toner concentration in the developer is executed, to thereby suppress a reduction in image density and maintain the image density during the print job.

If such a print job of continuously forming images having a relatively low image area ratio is followed by a print job of continuously forming images having a relatively high image area ratio (e.g., approximately 100%), the target toner concentration is still set to a relatively high value at the beginning of the latter print job, and an actual toner concentration is higher than usual. If the print job of images having a relatively high image area ratio starts in this state, much of the overcharged toner in the development device is soon consumed by the development process of the image forming operation of the images having a relatively high image area ratio. Then, in a relatively short period of time taken to form a few to dozens of images, most of the toner to be used in the development process is replaced by newly supplied toner having an appropriate toner charge.

FIG. 2 is a graph illustrating transition of the toner concentration in a print job of continuously forming images having a relatively high image area ratio that follows a print job of continuously forming images having a relatively low image area ratio. FIG. 3 is a graph illustrating transition of the image density in this case. In FIGS. 2 and 3, broken lines indicate the results of a related-art image forming apparatus having the foregoing configuration which changes the target toner concentration to adjust the image density, and solid lines indicate the results of a later-described image forming apparatus according to an earlier application of the present inventor.

At a point ta in FIG. 2, at which most of the toner to be used in the development process has been replaced by newly supplied toner having an appropriate toner charge, as described above, the toner concentration has barely changed from the toner concentration at the end of the previous print job, i.e., from the toner concentration adjusted for the overcharged toner, and is substantially higher than a toner concentration appropriate for the toner having the appropriate toner charge, as indicated by the broken line in FIG. 2. After the point ta in a period A, therefore, a shortage of the toner charge is caused by an excessive amount of toner in the developer, and the image density is higher than a target image density, as indicated by the broken line in FIG. 3.

Meanwhile, after the start of the print job, a control of forming predetermined toner patches, detecting respective toner adhesion amounts thereof, and adjusting the target toner concentration based on the detection results is executed at every formation of, for example, ten images. In the print job of images having a relatively high image area ratio following the print job of images having a relatively low image area ratio, a control of reducing the target toner concentration is executed in the target toner concentration adjustment control after the start of the print job to correct the state in which the image density is relatively high, as described above. Therefore, the toner concentration in the developer of the development device is gradually reduced, as indicated by the broken line in FIG. 2. Then, the time elapses to a point near the end of the period A, at which the toner concentration has been reduced to a certain level, and a relatively large amount of overcharged toner unused in the development process and continuously affected by the mixing operation remains in the development device owing to the continuing state of excess of the toner amount. As a result, the toner used in the development process contains a relatively large amount of overcharged toner, causing an insufficient image density in a period B, as indicated by the broken line in FIG. 3.

As described above, in the image forming apparatus which changes the target toner concentration to adjust the image density, if two consecutive print jobs are substantially different from each other in, for example, the image area ratio, a substantial change in image density occurs in the latter print job, making it difficult to maintain the target image density.

However, the present inventor has found that, if a print job of images having a relatively high image area ratio follows a print job of images having a relatively low image area ratio, as in the above-described specific example, phenomena such as unstable image density, stain in a non-image area, and toner scattering occur during the print job, particularly in an early stage of the print job, even if the control of adjusting the toner concentration to the value suitable for the relatively high image area ratio of the print job has been executed before the print job. Further, the present inventor has found from investigations that these phenomena occur due to the following reason.

FIG. 4 is a graph plotting toner charge distribution by size of charge in the development device, obtained when the image forming apparatus according to the earlier application adjusts, after a print job of images having a relatively low image area ratio, the toner concentration to a value suitable for a relatively high image area ratio of the next print job, and then executes the print job of images having the relatively high image area ratio.

During the print job of images having a relatively low image area ratio, the toner consumption by the image formation is relatively small, as described above. Therefore, a relatively large amount of toner remains in the development device, without being used in the development process. As a result, overcharged toner continuously affected by the mixing operation and having a toner charge larger than usual is increased in the development device. Further, the toner affected by the mixing operation is degraded in charging performance, and acts as weakly charged toner having a toner charge smaller than usual, or acts as inversely charged toner charged to a polarity opposite to a target polarity. In a state in which the toner amount consumed by the development process is relatively small, as in the print job of images having a relatively low image area ratio, the toner concentration is increased by the target toner concentration adjustment control executed during the print job, and thereby the toner amount in the developer is increased. Accordingly, the amount of depleted toner, such as weakly charged toner and inversely charged toner, is particularly increased.

The image forming apparatus can be configured to adjust the toner concentration after the print job of images having a relatively low image area ratio. This adjustment of the toner concentration, however, does not result in a reduction of the depleted toner in the development device. As illustrated in FIG. 4, a relatively large amount of depleted toner, such as weakly charged toner and inversely charged toner, is present in the developer of the development device for a while after the start of the subsequent print job of images having a relatively high image area ratio. If a relatively large amount of weakly charged toner is present in the developer, the toner adhesion amount per unit latent image area changes, making it difficult to stabilize the image density at the target image density. Further, if a relatively large amount of inversely charged toner is present in the developer, phenomena such as stain in a non-image area and toner scattering occur.

The above-described phenomena are not limited to the case in which a print job of images having a relatively low image area ratio shifts to a print job of images having a relatively high image area ratio, and may similarly occur, in different degrees, in a case in which the print job has a substantial change in, for example, the toner consumption index value, such as the image area ratio, including a case in which a print job of images having a relatively high image area ratio shifts to a print job of images having a relatively low image area ratio.

SUMMARY OF THE INVENTION

The present invention provides a novel image forming apparatus that, in one example, includes a latent image carrier, a development device, a toner supply device, a forced toner consumption controller, a toner supply controller, and a pre-job controller. The latent image carrier is configured to carry a latent image formed thereon in accordance with an input of an image forming job. The development device is configured to develop the latent image with a two-component developer including toner and carrier, to thereby form a toner image to be transferred to a recording medium. The toner supply device is configured to supply, at predetermined intervals, the development device with toner by an amount consumed in the development of the image. The forced toner consumption controller is configured to execute a forced toner consumption control of causing the toner in the development device to adhere to a non-image area in a surface of the latent image carrier and be forcibly consumed. The toner supply controller is configured to execute a toner supply control of causing the toner supply device to supply the development device with toner to make a toner concentration in the developer of the development device approach a specific target toner concentration. The pre-job controller is configured to, upon receipt of the input of the image forming job, and before the start of image formation of the image forming job, acquire a toner consumption index value serving as an index of toner consumption per image to be formed by the input image forming job, determine a specific target image density based on the acquired toner consumption index value, and execute a previous toner consumption and supply control and then a previous image density adjustment control. The previous toner consumption and supply control causes the forced toner consumption controller to execute the forced toner consumption control, and causes the toner supply controller to execute the toner supply control to make the toner concentration in the developer of the development device subjected to the forced toner consumption control approach the specific target toner concentration. The previous image density adjustment control adjusts one or more image forming conditions to make an image density after the previous toner consumption and supply control approach the specific target image density.

The image forming apparatus may further include an image density adjustment controller configured to execute, at predetermined intervals during a continuous image forming job of continuously forming images, an image density adjustment control of adjusting one or more image forming conditions including the target toner concentration, to make the image density approach the specific target image density. The pre-job controller may determine the specific target toner concentration as a value of the target toner concentration adjusted within a specified range by the image density adjustment control repeated at the predetermined intervals in a continuous image forming job of continuously forming images corresponding to the acquired toner consumption index value.

The image forming apparatus may further include a toner adhesion amount detector. The pre-job controller may execute the previous image density adjustment control to form a latent pattern for image density adjustment on the surface of the latent image carrier, cause the development device to develop the latent pattern and thereby form the toner pattern, cause the toner adhesion amount detector to detect the toner amount adhering to the toner pattern, and adjust one or more image forming conditions based on the detected toner amount.

The pre-job controller may cause the developer in the development device to be mixed after the previous toner consumption and supply control and before the previous image density adjustment control.

The pre-job controller may execute the toner supply control while executing the forced toner consumption control.

The image forming apparatus may further include an input device configured to receive an instruction from an operator and a selector configured to select, in accordance with the instruction received by the input device, whether or not to cause the pre-job controller to execute the previous toner consumption and supply control and the previous image density adjustment control.

The image forming apparatus may further include an image formation history storage device configured to store a toner consumption index value serving as an index of toner consumption per image formed in a predetermined past period of time. The pre-job controller may determine, based on the acquired toner consumption index value and the toner consumption index value stored in the image formation history storage device, the specific target image density to be used in the previous toner consumption and supply control.

The image forming apparatus may further include a carrier deterioration index value storage device configured to store a carrier deterioration index value serving as an index of the degree of deterioration of the carrier in the development device. The pre-job controller may determine, based on the acquired toner consumption index value and the carrier deterioration index value stored in the carrier deterioration index value storage device, the specific target image density to be used in the previous toner consumption and supply control.

The image forming apparatus may further include a detector configured to detect at least one of temperature and humidity. The pre-job controller may determine, based on the acquired toner consumption index value and a detection result obtained by the detector, the specific target image density to be used in the previous toner consumption and supply control.

The image forming apparatus may further include a retention time storage device configured to store a retention time for which the developer is left unused with no image forming operation performed after a previous image forming job. The pre-job controller may determine, based on the acquired toner consumption index value and the retention time stored in the retention time storage device, the specific target image density to be used in the previous toner consumption and supply control.

A toner supply control method is provided for an image forming apparatus which includes a latent image carrier configured to carry a latent image formed thereon in accordance with an input of an image forming job; a development device configured to develop the latent image with a two-component developer including toner and carrier, to thereby form a toner image to be transferred to a recording medium; and a toner supply device configured to supply, at predetermined intervals, the development device with toner by an amount consumed in the development of the image. The method includes receiving the input of the image forming job; acquiring a toner consumption index value serving as an index of toner consumption per image to be formed by the input image forming job; determining a specific target image density based on the acquired toner consumption index value; executing a forced toner consumption control of causing the toner in the development device to adhere to a non-image area in a surface of the latent image carrier and be forcibly consumed; executing a toner supply control of causing the toner supply device to supply the development device with toner to make a toner concentration in the developer of the development device subjected to the forced toner consumption control approach a specific target toner concentration; executing a previous image density adjustment control of adjusting one or more image forming conditions to make an image density after the forced toner consumption control and the toner supply control approach the specific target image density; and performing image formation of the image forming job.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
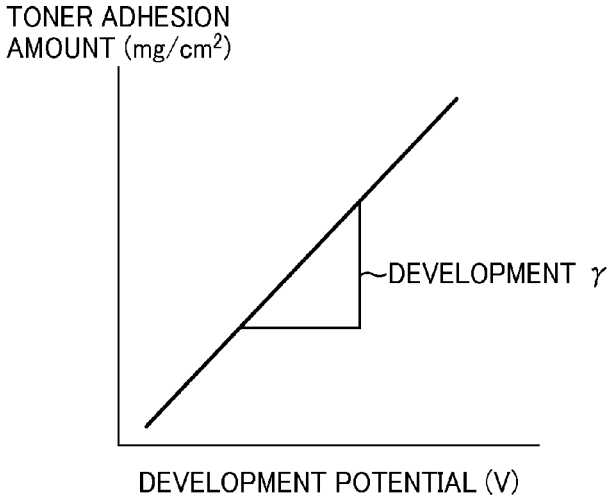
FIG. 1 RELATED ART
FIG. 1 is a diagram of development γ representing the relationship between development potential and toner adhesion amount per unit latent image area.
Figure 2:
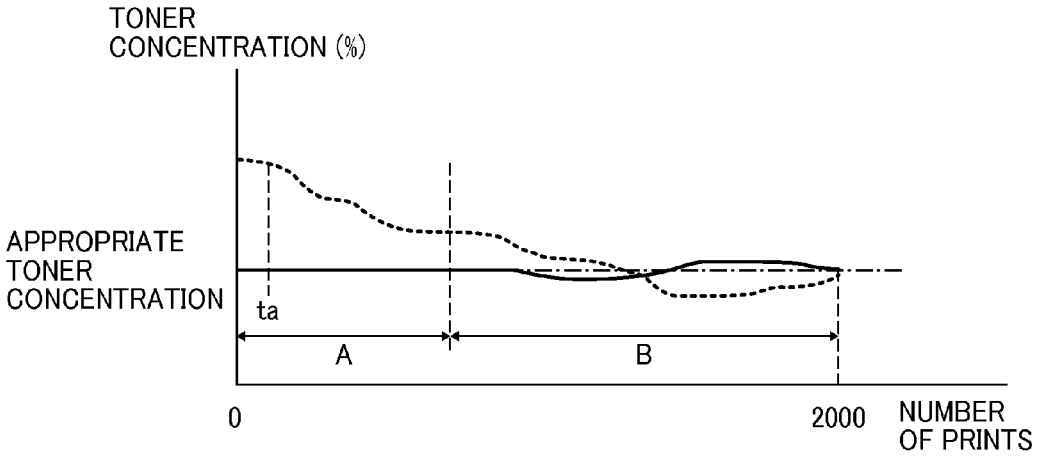
FIG. 2 RELATED ART
FIG. 2 is a graph illustrating transition of toner concentration in a print job of continuously forming images having a relatively high image area ratio, which follows a print job of continuously forming images having a relatively low image area ratio.
Figure 3:
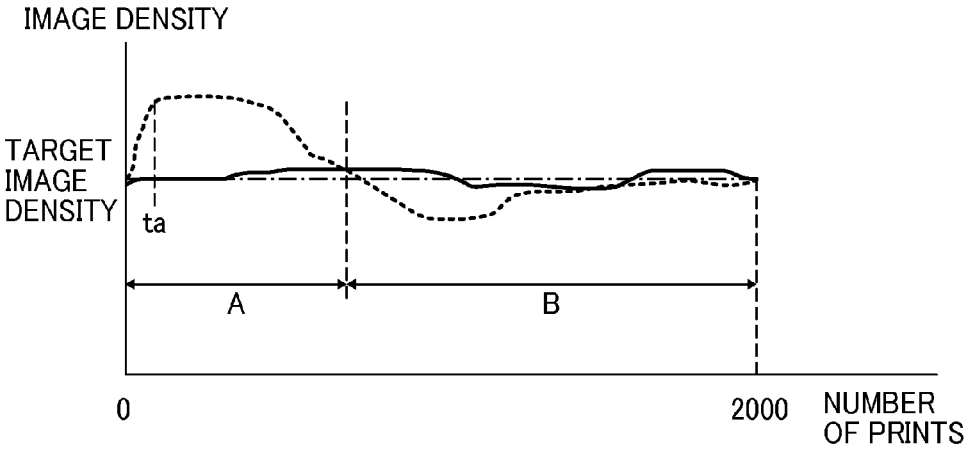
FIG. 3 RELATED ART
FIG. 3 is a graph illustrating transition of image density in a print job of continuously forming images having a relatively high image area ratio, which follows a print job of continuously forming images having a relatively low image area ratio.
Figure 4:
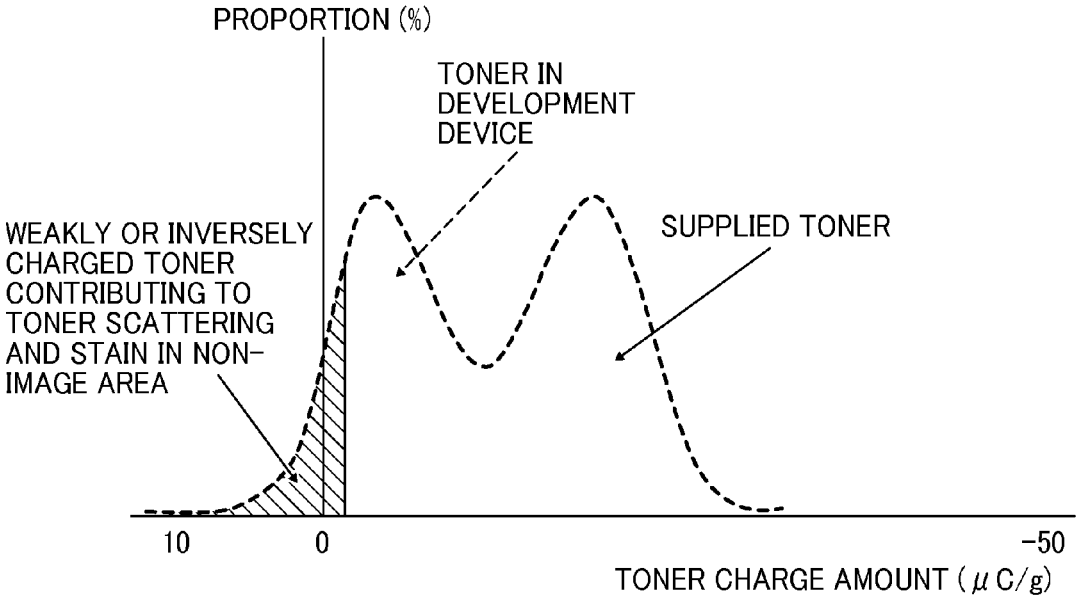
FIG. 4 RELATED ART
FIG. 4 is a graph of a toner charge distribution in the development device, which is obtained by adjusting, after a print job of images having a relatively low image area ratio, the toner concentration to a value suitable for a relatively high image area ratio of the next print job, and then executing the print job of images having the relatively high image area ratio.

In describing the embodiments illustrated in the drawings, specific terminology is adopted for the purpose of clarity. However, the disclosure of the present invention is not target to be limited to the specific terminology so used, and it is to be understood that substitutions for each specific element can include any technical equivalents that have the same function, operate in a similar manner, and achieve a similar result.

Figure 5:
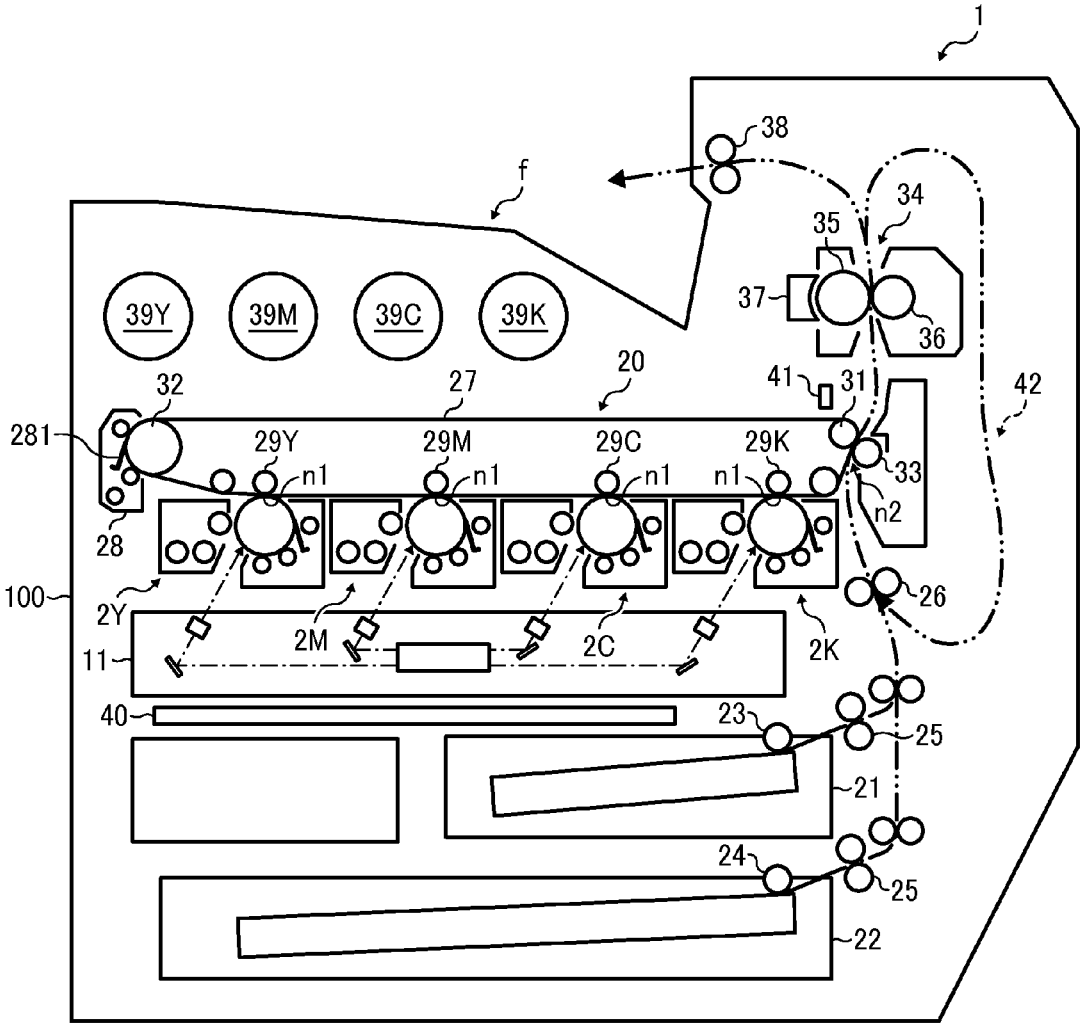
FIG. 5 is a schematic configuration diagram illustrating a printer according to an embodiment of the present invention.

Referring now to the drawings, wherein like reference numerals designate identical or corresponding parts throughout the several views, an embodiment of an electrophotographic printer will be described as an image forming apparatus according to an embodiment of the present invention. A description will first be given of a basic configuration of a printer 1 according to the present embodiment. FIG. 5 is a schematic configuration diagram illustrating the printer 1 according to the present embodiment. In FIG. 5, the printer 1 includes a printer body 100 including toner bottles 39Y, 39M, 39C, and 39K, process units 2Y, 2M, 2C, and 2K, an exposure unit 11, a first sheet feeding cassette 21, a second sheet feeding cassette 22, a first sheet feed roller 23, a second sheet feed roller 24, a plurality of feed roller pairs 25, a registration roller pair 26, a transfer unit 20, a fixing unit 34, a sheet discharge roller pair 38, a controller 40, and a recording sheet reversing unit 42. The transfer unit 20 includes an intermediate transfer belt 27, a belt cleaning unit 28 including a cleaning blade 281, a toner adhesion amount sensor 41, primary transfer rollers 29Y, 29M, 29C, and 29K, a drive roller 31, a belt tension roller 32, and a secondary transfer roller 33. The fixing unit 34 includes a fixing roller 35, a pressure roller 36, and an induction heating (IH) coil unit 37.

In FIG. 5, the four process units 2Y, 2M, 2C, and 2K for yellow, magenta, cyan, and black (hereinafter referred to as Y, M, C, and K) colors serve as toner image forming devices. The process units 2Y, 2M, 2C, and 2K are similar in configuration except for the difference in color of Y, M, C, and K toners used therein as image forming substances for forming images. Hereinafter, the process units 2Y, 2M, 2C, and 2K will simply be referred to as the process units 2 without the suffixes of Y, M, C, and K, where distinction of the colors is unnecessary.

Figure 6:
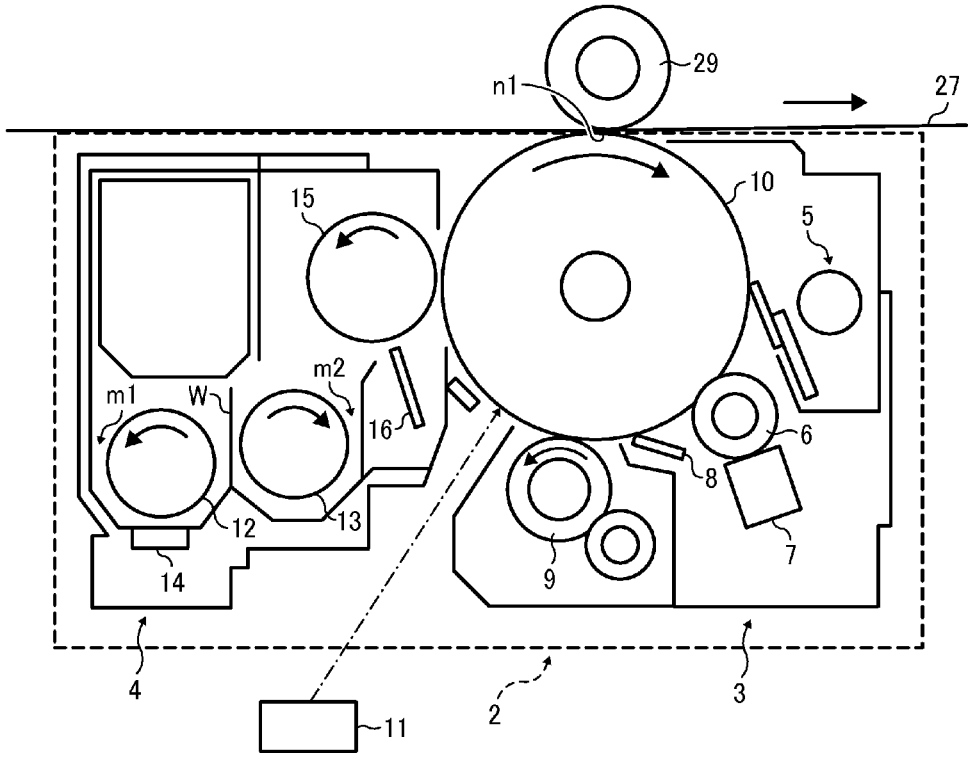
FIG. 6 is an explanatory diagram illustrating a schematic configuration of a process unit included in the printer.

The process unit 2 for forming a toner image is illustrated in FIG. 6, which is a schematic cross-sectional view of the process unit 2 serving as the image forming unit. The process unit 2 for forming a toner image includes a photoconductor drum unit 3 and a development unit 4 serving as a development device. The photoconductor drum unit 3 and the development unit 4 are integrally attachable to and detachable from the printer body 100 illustrated in FIG. 5.

The photoconductor drum unit 3 includes a drum-shaped photoconductor drum 10, a drum cleaning device 5, a lubricant application brush 6, a lubricant 7, a lubricant application blade 8, and a charging roller 9. The drum-shaped photoconductor drum (hereinafter referred to as the photoconductor drum) 10 serves as a latent image carrier. The drum cleaning device 5 serves as a latent image carrier cleaning device which removes and collects post-transfer residual toner and so forth adhering to the photoconductor drum 10. The lubricant application brush 6 adjusts the coefficient of friction of an outer circumferential surface of the photoconductor drum 10 to a predetermined value. The lubricant 7 is made of zinc stearate. The lubricant application blade 8 uniformly applies the lubricant 7 to the photoconductor drum 10. The charging roller 9 uniformly charges the photoconductor drum 10. Specifically, the photoconductor drum 10 is driven to rotate clockwise in FIG. 6 by a not-illustrated driving device, and the charging roller 9 uniformly charges the outer circumferential surface of the rotating photoconductor drum 10 with a charge bias having an alternating-current (AC) voltage superimposed with a direct-current (DC) voltage and applied by a not-illustrated charge bias application device. Then, the outer circumferential surface of the photoconductor drum 10 is subjected to exposure scanning with laser light according to image information emitted from the exposure unit 11. Thereby, an electrostatic latent image is formed on the outer circumferential surface of the photoconductor drum 10.

The development unit 4 includes a first developer container m1 housing a first transport screw 12, a second developer container m2 housing a second transport screw 13, a toner concentration sensor 14, a development sleeve 15, and a doctor blade 16. The toner concentration sensor 14 is a magnetic permeability sensor disposed on a lower surface of the first developer container m1. The mixing ratio of magnetic carrier particles and toner in developer is calculated from the magnetic permeability detected by the toner concentration sensor 14, and toner is supplied as necessary to the development unit 4 from a not-illustrated toner supply device to provide a predetermined toner concentration. The developer is contained in the development unit 4 to be flowable and mixable therein. In the developer filling development unit 4, toner mainly made of a polyester resin and having a volume average particle size of approximately 6 μm and carrier including magnetic fine particles having a volume average particle size of approximately 35 μm are uniformly mixed with a toner concentration of, for example, approximately 7 wt %.

The first transport screw 12 is driven to rotate by a not-illustrated driving device, and transports the developer in the first developer container m1 from the far side toward the near side in a direction perpendicular to the drawing plane. Thereby, the developer enters the second developer container m2 through a not-illustrated communication port provided in a dividing wall w between the first developer container m1 and the second developer container m2. The second transport screw 13 in the second developer container m2 is driven to rotate by a not-illustrated driving device, and transports the developer from the near side toward the far side in the drawing. Thereby, mixing and transport of the supplied toner simultaneously take place, and uniform mixing of the toner and the carrier and charging of the toner are performed.

The development sleeve 15 serving as a developer carrier is disposed above and parallel to the second transport screw 13, and is driven to rotate counterclockwise in FIG. 6. The development sleeve 15 includes a pipe made of a nonmagnetic material, such as aluminum, and having an outer circumferential surface subjected to a surface roughening treatment by sandblasting. With a not-illustrated magnet disposed inside the loop of the development sleeve 15, a part of the developer transported by the second transport screw 13 is attracted to and carried by the outer circumferential surface of the development sleeve 15 by magnetic force generated by the magnet. Then, the thickness of a layer of the developer is regulated by the doctor blade 16 disposed to maintain a predetermined gap between the development sleeve 15 and the doctor blade 16. Thereafter, the developer is transported to a development area facing the photoconductor drum 10. Then, with a development bias supplied to the development sleeve 15 from a not-illustrated development power source, the toner adheres to the electrostatic latent image formed on the photoconductor drum 10, thereby forming a toner image. In accordance with the rotation of the development sleeve 15, the developer having the toner consumed by the development process is returned to the second transport screw 13, transported to the far side in the drawing, and returned into the first developer container m1 through a not-illustrated communication port.

The magnetic permeability of the developer detected by the toner concentration sensor 14 is transmitted to the controller 40 as a voltage signal. The magnetic permeability of the developer is correlated with the toner concentration in the developer. Therefore, the toner concentration sensor 14 outputs a voltage according to the toner concentration. The controller 40 includes an information storage device, such as a random access memory (RAM), which stores a target toner concentration Vtref, i.e., the target value of the voltage output from the toner concentration sensor 14. The controller 40 compares the value of the voltage output from the toner concentration sensor 14 with the value of the target toner concentration Vtref, and causes the not-illustrated toner supply device to supply the first developer container m1 of the development unit 4 with toner from the far side in the drawing by an amount corresponding to the comparison result, to thereby maintain the toner concentration in the developer at the target toner concentration Vtref. The toner supply control using the toner concentration sensor 14 and the toner supply device is individually executed for each of the colors.

Below the process units 2Y, 2M, 2C, and 2K in FIG. 5, the exposure unit 11 serving as a latent image forming device is disposed which directs beams of laser light onto the respective outer circumferential surfaces of the photoconductor drums 10 of the process units 2Y, 2M, 2C, and 2K based on image information. Thereby, electrostatic latent images are formed on the photoconductor drums 10. In the exposure unit 11, which includes laser diodes serving as light sources, a polygon mirror, and a plurality of optical lenses and mirrors, beams of laser light emitted from the laser diodes are scanned by the polygon mirror driven to rotate by a not-illustrated motor, and are applied to the photoconductor drums 10 via the optical lenses and mirrors. It is to be noted that this configuration may be replaced by an exposure device including a light emitting diode (LED) array.

Below the exposure unit 11, the first sheet feeding cassette 21 and the second sheet feeding cassette 22 are disposed to vertically overlap each other. Each of the first sheet feeding cassette 21 and the second sheet feeding cassette 22 stores recording sheets each serving as a recording medium. The uppermost recording sheet in the first sheet feeding cassette 21 is in contact with the first sheet feed roller 23, and the uppermost recording sheet in the second sheet feeding cassette 22 is in contact with the second sheet feed roller 24. Each of the first sheet feed roller 23 and the second sheet feed roller 24 is driven to rotate counterclockwise in FIG. 5 at predetermined intervals by a not-illustrated driving device. Then, the uppermost recording sheet is fed to a sheet feed path provided to vertically extend on the right side of the first sheet feeding cassette 21 and the second sheet feeding cassette 22 in FIG. 5. The recording sheet fed to the sheet feed path is fed upward by the feed roller pairs 25 provided to the sheet feed path.

The sheet feed path is further provided with the registration roller pair 26. The recording sheet fed toward the registration roller pair 26 by the feed roller pairs 25 is temporarily stopped by the registration roller pair 26. Then, the registration roller pair 26 is driven at predetermined intervals to feed the recording sheet toward a secondary transfer nip n2 such that the recording sheet and a toner image formed on the intermediate transfer belt 27 reach the secondary transfer nip n2 at the same time.

Above the process units 2Y, 2M, 2C, and 2K in FIG. 5, the transfer unit 20 is disposed which causes the intermediate transfer belt 27 serving as an intermediate transfer member to rotate counterclockwise in FIG. 5 in a stretched state. The transfer unit 20 is a transfer device which includes the intermediate transfer belt 27, the belt cleaning unit 28, the toner adhesion amount sensor 41, the primary transfer rollers 29Y, 29M, 29C, and 29K, the drive roller 31, the belt tension roller 32, and the secondary transfer roller 33. The toner adhesion amount sensor 41 detects respective toner adhesion amounts of toner patterns for image density adjustment, which are timely transferred onto the intermediate transfer belt 27. The primary transfer rollers 29Y, 29M, 29C, and 29K are disposed at respective positions facing the photoconductor drums 10 of the respective colors. The drive roller 31 is externally driven to drive the intermediate transfer belt 27. The drive roller 31 also serves as a secondary transfer opposite roller facing the secondary transfer roller 33.

When the drive roller 31 is driven to rotate, the intermediate transfer belt 27 is rotated counterclockwise in FIG. 5, while being stretched around rollers including the drive roller 31, the belt tension roller 32, and the primary transfer rollers 29Y, 29M, 29C, and 29K. The primary transfer rollers 29Y, 29M, 29C, and 29K are in contact with the photoconductor drums 10 via the intermediate transfer belt 27, to thereby form primary transfer nips n1. The primary transfer rollers 29Y, 29M, 29C, and 29K are applied with a transfer bias having a polarity opposite that of the toners of the toner images formed on the photoconductor drums 10, thereby transferring the toner images on the photoconductor drums 10 onto the intermediate transfer belt 27. The toner images of the respective colors formed in the process units 2Y, 2M, 2C, and 2K are sequentially primary-transferred onto the intermediate transfer belt 27 to be superimposed upon one another, thereby forming a color toner image on the intermediate transfer belt 27.

The secondary transfer roller 33 is disposed outside the intermediate transfer belt 27 at a position facing, via the intermediate transfer belt 27, the drive roller 31 serving as the secondary transfer opposite roller. The secondary transfer roller 33 is brought into contact with the drive roller 31 with predetermined pressure by a biasing force applied by a not-illustrated biasing member, such as a spring, to thereby form the secondary transfer nip n2. When the intermediate transfer belt 27 is driven to rotate, the toner image formed thereon moves to the secondary transfer nip n2. In this process, the recording sheet fed by the registration roller pair 26 enters the secondary transfer nip n2 in synchronization with the entry of the toner image into the secondary transfer nip n2. The toner image is secondary-transferred onto the recording sheet by nip pressure and a secondary transfer electric field generated between the secondary transfer roller 33 and the drive roller 31. The secondary transfer electric field is generated by the secondary transfer roller 33 connected to a ground and the drive roller 31 applied with a transfer bias having the same polarity as that of the toners.

The toner adhesion amount sensor 41 is disposed downstream of the secondary transfer nip n2 in the rotation direction of the intermediate transfer belt 27. The toner adhesion amount sensor 41 detects the toner adhesion amounts of the toner images transferred to the intermediate transfer belt 27 from the photoconductor drums 10, such as the toner adhesion amounts of the toner patterns for image density adjustment timely transferred to the intermediate transfer belt 27, for example. The toner adhesion amount sensor 41 includes a reflective optical sensor, the output of which changes in accordance with the toner adhesion amount, and the toner adhesion amounts are detected based on the change in the output.

The intermediate transfer belt 27 having passed through the secondary transfer nip n2 has a slight amount of toners adhering thereto, having failed to be transferred to the recording sheet. Such residual toners are cleaned off by the belt cleaning unit 28. With the cleaning blade 281 kept in contact with the outer circumferential surface of the intermediate transfer belt 27, the belt cleaning unit 28 scrapes and removes the post-transfer residual toners from the intermediate transfer belt 27. The post-transfer residual toners removed from the intermediate transfer belt 27 are collected in a not-illustrated waste toner bottle and discarded.

Above the secondary transfer nip n2, the fixing unit 34 is disposed which includes the fixing roller 35, the pressure roller 36, the IH coil unit 37, and a not-illustrated temperature sensor. The fixing roller 35 includes an electromagnetic induction heat generating layer. The pressure roller 36 is brought into contact with the fixing roller 35 with predetermined pressure, to thereby form a fixing nip having a predetermined nip width. On the left side of the fixing roller 35 in FIG. 5, the IH coil unit 37 is disposed which is an electromagnetic induction device for generating heat in the electromagnetic induction heat generating layer of the fixing roller 35. The fixing roller 35 is heated by electromagnetic induction by the IH coil unit 37. The pressure roller 36 is rotated clockwise in FIG. 5 by a not-illustrated drive source, and the fixing roller 35 is rotated counterclockwise in FIG. 5 by a not-illustrated drive source.

The recording sheet having passed the secondary transfer nip n2 is separated from the intermediate transfer belt 27 and fed into the fixing unit 34. Then, the recording sheet is heated by the fixing roller 35, while being fed upward in FIG. 5 as nipped in the fixing nip of the fixing unit 34. At the same time, the recording sheet is applied with pressure in the fixing nip to fix the toner image on the recording sheet. The recording sheet thus subjected to the fixing process is then discharged outside the printer body 100 via the sheet discharge roller pair 38, and is placed onto an upper surface f of the printer body 100.

In a right portion of the printer body 100 in FIG. 5, the recording sheet reversing unit 42 is provided. In duplex printing, the rotation of the sheet discharge roller pair 38 is reversed after the recording sheet having an image formed on a front surface thereof has passed the fixing unit 34. Thereby, the recording sheet is switched back and fed to the recording sheet reversing unit 42. The recording sheet is then reversed and re-fed to the registration roller pair 26.

Above the transfer unit 20, the toner bottles 39Y, 39M, 39C, and 39K for the respective colors are disposed which contain the Y, M, C, and K toners, respectively. The toners of the respective colors contained in the toner bottles 39Y, 39M, 39C, and 39K are supplied as necessary to the respective development units 4 of the process units 2Y, 2M, 2C, and 2K for the respective colors. Each of the toner bottles 39Y, 39M, 39C, and 39K is attachable to and detachable from the printer body 100 to be replaced with a new toner bottle when running out of the toner contained therein.

Description will now be given of an example of a process control, i.e., an image density adjustment control of the present embodiment. The following description is of an example of such control, and does not limit the timing and method of controlling one or more image forming conditions.

When the printer 1 is activated by turning the power supply on, the respective motors and biases are turned on to prepare for the execution of the process control. Then, the toner adhesion amount sensor 41 is calibrated as necessary. In the present embodiment, the toner adhesion amount sensor 41 is an optical sensor including a light emitting portion, such as a LED, and a plurality of light receiving portions including a regular reflection light receiving portion. The light emission amount of the light emitting portion is adjusted such that the output of the regular reflection light receiving portion is approximately 4 V. An output Vt0 of the toner concentration sensor 14 (i.e., magnetic permeability sensor) of the development unit 4 is acquired. The output Vt0 is measured to detect the current toner concentration, and is used in later-described correction of the target toner concentration Vtref.

Then, gradation patterns, i.e., toner patterns for image density adjustment are formed to detect the current development γ. In the present embodiment, the gradation patterns are formed on the intermediate transfer belt 27 at a position corresponding to the position of the toner adhesion amount sensor 41 in the width direction of the intermediate transfer belt 27, with an inter-pattern interval of approximately 50 mm. Each of the gradation patterns includes ten toner patches having different toner adhesion amounts and having a width in a main scanning direction of approximately 15 mm and a width in a sub-scanning direction of approximately 16 mm. Latent patterns for the toner patterns are formed with exposure power set to a maximum value and the potential of the latent patterns sufficiently reduced, and the gradation patterns are formed with the development bias and the charge bias set to different values for the respective patches.

Respective toner adhesion amounts of the toner patches of the thus-formed gradation patterns are measured by the toner adhesion amount sensor 41, and the development γ and a development start voltage are determined from the relationship between the development biases and the toner adhesion amounts, i.e., the detection results of the toner adhesion amount sensor 41, for the respective patches. Specifically, as illustrated in FIG. 1, a linear expression is given by the least squares method, with the horizontal axis representing the development potential and the vertical axis representing the toner adhesion amount as the detection result of the toner adhesion amount sensor 41. Herein, the potential of the latent images is substantially zero, and thus the value of the development potential is substantially equal to the development bias. Then, the slope of the liner expression is determined as the development γ, and the intercept on the horizontal axis is determined as the development start voltage.

On the basis of the thus-determined development γ, the development potential for obtaining the toner adhesion amount corresponding to a predetermined specified image density is determined. Herein, the development potential substantially matches the development bias. In the present embodiment, the specified image density corresponds to a maximum image density. The toner adhesion amount corresponding to the maximum image density is determined by the degree of pigmentation of a toner pigment, and normally ranges from approximately 0.4 mg/cm$^2$ to approximately 0.6 mg/cm$^2$.

On the basis of the thus-determined development potential, the development bias to be used in a future print job is set. Further, the charge bias is set to a value not causing scattering of the carrier to the photoconductor drum 10. In the present embodiment, if the development bias ranges from approximately 400 V to approximately 700 V, for example, the charge bias is set to a value higher than the development bias by approximately 100 V. The thus-set development bias and charge bias are stored in the RAM of the controller 40 in the printer body 100 to be used in the future print job.

Then, the target toner concentration Vtref is corrected based on the determined development γ and the output Vt0 of the toner concentration sensor 14. Specifically, a difference Δγ is calculated by subtraction of the target value of the development γ from the detected value of the development γ. Herein, the target value of the development γ is predetermined for each development device, and is set to approximately 1.0 mg/cm$^2$/kV, for example. The target value of approximately 1.0 mg/cm$^2$/kV of the development γ indicates that, when the development potential is approximately 1 kV, the toner adhesion amount adhering to the electrostatic latent image on the photoconductor drum 10 is approximately 1.0 mg/cm$^2$. For example, if the development start voltage is approximately 0 V and the toner adhesion amount corresponding to the specified image density is approximately 0.5 mg/cm$^2$, a development potential of approximately 500 V is necessary. The development potential corresponds to the difference between the development bias and the electrostatic latent image potential. If the electrostatic latent image potential is approximately 100 V, therefore, the development bias is set to approximately 600 V. The electrostatic latent image potential corresponds to the surface potential of the exposed photoconductor drum 10, and depends on factors such as exposure power and photosensitivity of the photoconductor drum 10.

If the difference Δγ deviates from a predetermined range, the development bias depending on the difference Δγ exceeds an adjustable range of the development bias. The use of the development bias exceeding the adjustable range results in an abnormal image. If the deviation of the difference Δγ from the predetermined range is detected, therefore, the target toner concentration Vtref is corrected to obtain the target image density. In this case, however, if the toner concentration, i.e., the output Vt0 of the toner concentration sensor 14 (i.e., magnetic permeability sensor) is substantially different from the target toner concentration Vtref, the target toner concentration Vtref is not corrected.

The target toner concentration Vtref may be corrected in accordance with, for example, the following correction conditions. Under a first correction condition in which relationships $\Delta\gamma \geq 0.30$ (mg/cm$^2$/kV) and $(Vt0-Vtref) \geq -0.2$ (V) hold, the target toner concentration Vtref is set to Vt0−0.2 (V). That is, under the first correction condition, the target toner concentration Vtref is set to reduce the current toner concentration. Meanwhile, under a second correction condition in which relationships $\Delta\gamma < 0.30$ (mg/cm$^2$/kV) and $(Vt0-Vtref) < 0.2$ (V) hold, the target toner concentration Vtref is set to Vt0+0.2 (V). That is, under the second correction condition, the target toner concentration Vtref is set to increase the current toner concentration. Under a condition other than the first and second correction conditions, the previous value of the target toner concentration Vtref continues to be used without correction of the target toner concentration Vtref.

Description will now be given of the toner supply control executed during the print job by the printer 1 of the present embodiment. When printing of the first image starts upon execution of the print job, an output Vt1 of the toner concentration sensor 14, i.e., the toner concentration in the printing of the first image (hereinafter referred to as the current toner concentration Vt1) is acquired. Then, the difference between the current toner concentration Vt1 and the target toner concentration Vtref is calculated. Further, image information concerning the printing of the first image is acquired, and an image area S1 of the first image is calculated from the number of pixels and the resolution of the first image. The toner adhesion amount per unit latent image area has previously been acquired. It is therefore possible to estimate, from the image area S1 of the first image, the toner amount to be consumed in the printing of the first image. From the difference between the current toner concentration Vt1 and the target toner concentration Vtref and the image area S1 of the first image obtained as described above, a toner supply amount H2 to be supplied in the printing of the second image is calculated.

The toner supply control will now be described with reference to a specific example. The toner supply amount Hn+1 (mg) for the printing of the next (n+1)-th image is calculated by the following formula (I):

$$Hn+1=K1\times(Vtn-Vtref)+K2\times Sn\times(1+K3\times(Vtn-Vtref)) \quad (1)$$

Herein, proportionality factors K1, K2, and K3 are constants. For example, when the proportionality factor K1 is 50, the current toner concentration Vtn is 3.20 V, the target toner concentration Vtref is 3.00 V, the proportionality factor K2 is 0.5, the current image area Sn is 31 $cm^2$, and the proportionality factor K3 is 0.5, the toner supply amount Hn+1 for the printing of the next (n+1)-th image is Hn+1=50×0.2+0.5×31×(1+0.5×0.2)=27.05 mg.

After the toner supply amount for the printing of the next image is thus calculated, the printing of the next image starts. Then, a not-illustrated toner supply clutch is turned on for an ON time according to the toner supply amount. The ON time is determined in accordance with the calculated toner supply amount and toner supply capability of the toner supply device. With this toner supply operation, the first developer container m1 of the development unit 4 is supplied with toner by the amount consumed in the printing of the previous image. Thereby, the toner concentration in the developer is stably maintained at the target toner concentration.

Description will now be given of a pre-job control of the present embodiment, which is executed before the print job. The pre-job control includes a previous toner consumption and supply control and a previous image density adjustment control.

As noted above, a substantial change in, for example, the image area ratio of the print job may result in a substantial change in image density in a print job after the change. In this case, it is difficult to maintain the target image density. In particular, when a print job of images having a relatively low image area ratio shifts to a print job of images having a relatively high image area ratio, the depleted toner remaining in the development unit 4 during the print job of images having a relatively low image area may cause phenomena such as stain in a non-image area and toner scattering. When a print job of images having a relatively low image area ratio shifts to a print job of images having a relatively high image area ratio, therefore, the present embodiment executes the following pre-job control before the print job of images having a relatively high image area ratio. The following description will be given of, as an example, a case in which the same prints are continuously printed in bulk of tens of thousands in one print job for production printing. The pre-job control of the present embodiment is also applicable to other printing, such as printing in office environments.

Figure 7:
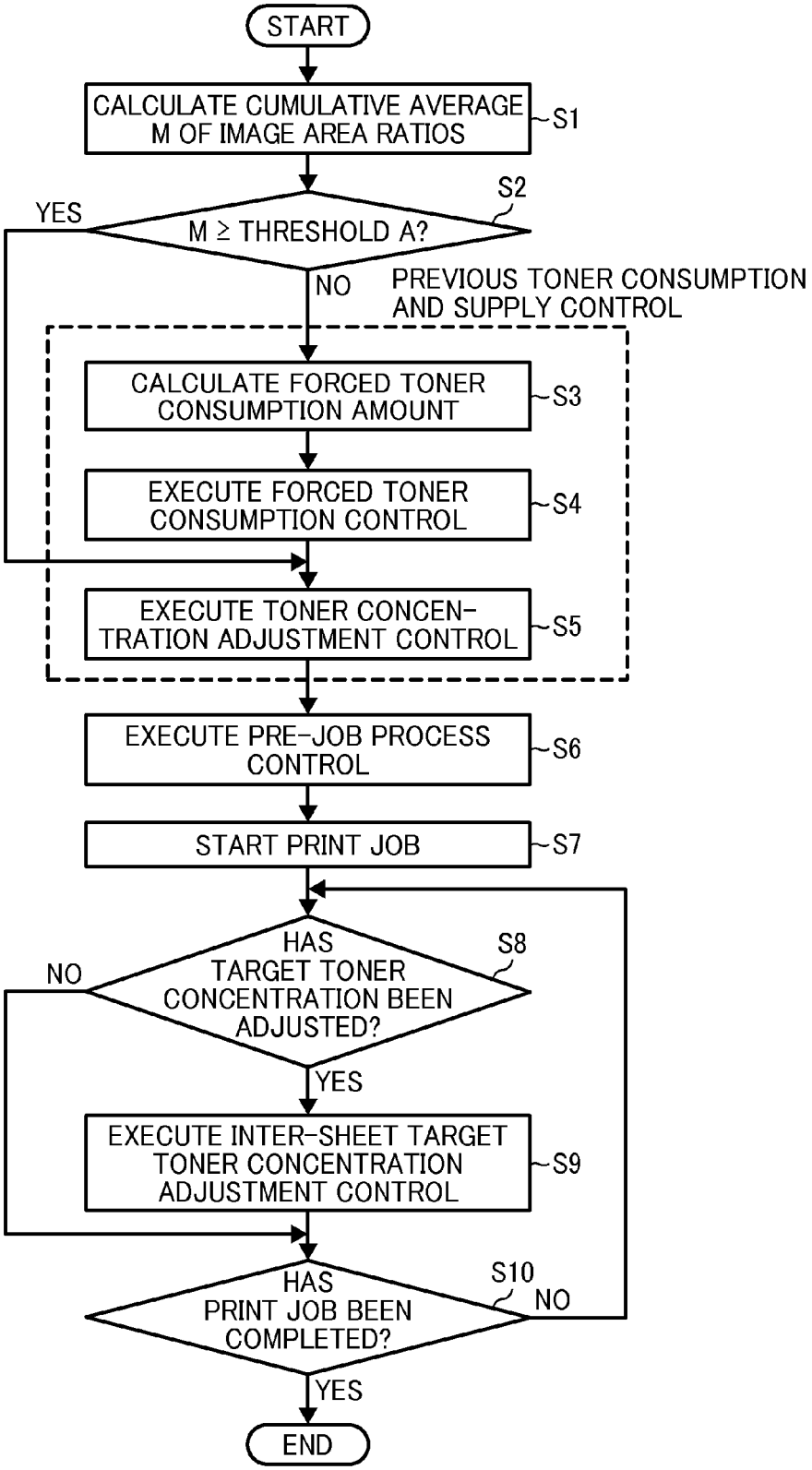
FIG. 7 is a flowchart illustrating steps in a process of control for adjusting image density, which includes a pre-job control of the embodiment.

FIG. 7 is a flowchart illustrating steps in a process of control for adjusting the image density, which includes the pre-job control of the present embodiment. In the present embodiment, upon input of a new print job, whether or not to execute the previous toner consumption and supply control is first determined based on the cumulative average M of the image area ratios of the images formed in a predetermined past period of time. Specifically, the controller 40 calculates, from the image information of past print jobs, the cumulative average M of the image area ratios of the images formed in a predetermined past period of time (step S1). Then, if the calculated cumulative average M of the image area ratios is less than a threshold A (NO at step S2), the previous toner consumption and supply control (steps S3 to S5) is executed. Meanwhile, if the calculated cumulative average M of the image area ratios is equal to or greater than the threshold A (YES at step S2), a toner concentration adjustment control of the previous toner consumption and supply control (step S5) is executed.

In the previous toner consumption and supply control, a forced toner consumption control (steps S3 and S4) is first executed which causes the toner in the development unit 4 to adhere to a non-image area of the outer circumferential surface of the photoconductor drum 10, to thereby forcibly consume the toner in the development unit 4. The toner amount to be forcibly consumed by the forced toner consumption control may be constant. In the present embodiment, however, the toner amount to be forcibly consumed is determined based on the above-described cumulative average M of the image area ratios (step S3). Specifically, the toner amount to be forcibly consumed is increased in accordance with the reduction of the cumulative average M of the image area ratios, i.e., in accordance with the increase of the difference between the cumulative average M of the image area ratios and the threshold A.

In the forced toner consumption control, electrostatic latent images for toner consumption patterns are formed on the photoconductor drum 10 by the exposure unit 11, and are developed by the development unit 4, to thereby consume the toner in the development unit 4. In the present embodiment, the toner consumption patterns (i.e., toner image) thus formed on the photoconductor drum 10 are primary-transferred onto the intermediate transfer belt 27, and are collected by the belt cleaning unit 28. In this process, the secondary transfer roller 33 is kept separated from the intermediate transfer belt 27 by a not-illustrated contacting and separating mechanism.

After the thus-executed forced toner consumption control, the toner concentration adjustment control is executed (step S5). Alternatively, the toner concentration adjustment control may be executed in parallel with the forced toner consumption control. In the toner concentration adjustment control, the toner supply operation is performed such that the toner concentration in the developer of the development unit 4 approaches a specific target toner concentration determined based on the image area ratio of the image to be formed in the input print job. Herein, the image area ratio serves as a toner consumption index value. Specifically, the image area ratio of the image to be formed in the print job is calculated from the image information of the input print job. If the input print job continuously forms images having different image area ratios, a value such as a mean, mode, or median of the image area ratios of two or more images to be printed in an early stage of the print job is used.

The specific target toner concentration may be calculated by the use of a predetermined arithmetic expression based on the image area ratio (i.e., toner consumption index value) of the print job, or may be determined by the use of a data table representing the correspondence between the image area ratio and the specific target toner concentration. Such an arithmetic expression or data table may be determined based on, for example, previously conducted experiments.

The toner concentration in the developer of the development unit 4 is pre-adjusted to the specific target toner concentration. The specific target toner concentration is determined as a value capable of reducing fluctuations in toner concentration after the start of the print job corresponding to the image area ratio, as compared with a case in which the toner concentration is not pre-adjusted to the specific target toner concentration. As described later, in the present embodiment, an inter-sheet target toner concentration adjustment control, i.e., an image density adjustment control of adjusting the target toner concentration, is executed in a predetermined image non-forming time (i.e., inter-sheet time) during the print job to make the image density approach the target image density (step S9). In the inter-sheet target toner concentration adjustment control, solid toner patches of the respective colors are formed, and the toner adhesion amount of each of the solid toner patches is detected by the toner adhesion amount sensor 41. Then, if the toner adhesion amount is less than a target value, the target toner concentration is increased. If the toner adhesion amount is greater than the target value, the target toner concentration is reduced.

If the inter-sheet target toner concentration adjustment control is repeated during a print job of continuously forming images having a constant image area ratio, the adjusted target toner concentration eventually stabilizes. The present inventor has found that the target toner concentration thus settling to a steady value is highly correlated with the image area ratio of the print job. On the basis of this new finding, therefore, the present embodiment is configured such that the relationship between the image area ratio of the print job and the target toner concentration settling to a steady value during the print job is previously obtained from experiments and is stored in the information storage device, such as the RAM, by the controller 40 in the form of a data table or arithmetic expression to obtain the specific target toner concentration.

After the thus-executed toner concentration adjustment control, a pre-job process control, i.e., a previous image density adjustment control for determining a development condition suitable for the adjusted toner concentration, is executed (step S6). The pre-job process control is substantially similar to the foregoing process control. However, the adjustment target of the pre-job process control is not the target toner concentration but the development condition.

After the thus-executed pre-job control, the print job starts (step S7). In the present embodiment, the inter-sheet target toner concentration adjustment control as an image density adjustment control is executed (step S9) at predetermined intervals during the print job, such as at every formation of ten images, for example. In the inter-sheet target toner concentration adjustment control, the above-described solid toner patches are formed in an inter-sheet area (i.e., non-image area) between two adjacent toner images and detected by the toner adhesion amount sensor 41, and the target toner concentration is changed as necessary.

If the number of images to be formed in the print job is relatively large, an image density adjustment control similar to the foregoing process control may be executed at predetermined intervals during the print job, such as every two thousand images, for example. That is, an image density adjustment control may be executed which forms gradation patterns, detects the toner adhesion amounts thereof, determines the development γ, and adjusts, for example, the development condition, such as the development bias.

The foregoing previous toner consumption and supply control may be followed by preliminary mixing, in which the first transport screw 12 and the second transport screw 13 are driven to mix the developer in the development unit 4 in a state in which the toner in the development unit 4 is not consumed. The first transport screw 12 and the second transport screw 13 are also driven during the previous toner consumption and supply control, and thus the developer in the development unit 4 has been mixed to some extent at the end of the previous toner consumption and supply control. With the mixing of the developer during the previous toner consumption and supply control alone, however, the toner in the developer may be insufficiently dispersed or charged. In such a case, therefore, it is preferable to perform the preliminary mixing.

Further, in the present embodiment, whether or not to execute the previous toner consumption and supply control is determined based on the cumulative average of the image area ratios of the images formed in a predetermined past period of time. Alternatively, the determination may be made based on another condition. For example, a user or operator of the printer 1 of the present embodiment may issue an instruction as to whether or not to execute the previous toner consumption and supply control by operating a not-illustrated operation panel provided to the printer body 100 or by operating an input device, such as an external device (e.g., personal computer) connected to the printer 1, and whether or not to execute the previous toner consumption and supply control may be determined based on the instruction.

Further, the previous toner consumption and supply control involves the forced toner consumption control, and thus the toner discarded without being used in the image formation is increased. Therefore, it is useful to allow the user to select the priority between a reduction of the toner amount discarded without being used in the image formation and high image quality obtained by the previous toner consumption and supply control. Further, the execution of the previous toner consumption and supply control delays the execution of the print job by the time taken for the control. Therefore, the user may be allowed to select the priority between speed-up of the print start time and high image quality obtained by the previous toner consumption and supply control. The previous toner consumption and supply control may, of course, always be executed.

Description will now be given of effects of the pre-job control of the present embodiment. In a two-component developer, the toner concentration and the toner charge are normally related such that the toner charge is reduced in accordance with the increase in toner concentration. Further, development performance (i.e., development γ) and the toner charge are normally related such that the development performance deteriorates in accordance with the increase in toner charge. Meanwhile, in the output of images with a constant image area ratio, an average residence time of the toner in the development unit 4 and the image area ratio are related such that the average residence time of the toner in the development unit 4 is reduced in accordance with the increase in image area ratio. Further, the toner charge is increased in accordance with the increase in the average residence time of the toner in the development unit 4. Therefore, the image area ratio and the toner charge are related such that the toner charge is reduced in accordance with the increase in image area ratio. The toner charge, however, tends to be reduced after the mixing time of the developer exceeds a certain period of time.

Figure 8:
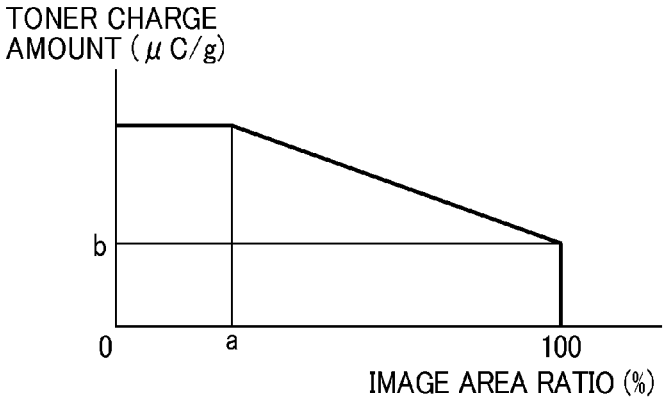
FIG. 8 is a graph illustrating the relationship between image area ratio and toner charge settling to a steady value, which is obtained when the pre-job control and an inter-sheet target toner concentration adjustment control are not executed.

When images having different image area ratios are continuously output by the printer 1 of the present embodiment without the execution of the pre-job control and the inter-sheet target toner concentration adjustment control until the toner charge in the development unit 4 settles to a steady value, i.e., until the change in toner charge substantially disappears, the image area ratio and the toner charge are related as illustrated in FIG. 8.

As described above, the toner concentration and the toner charge are related such that the toner charge is reduced in accordance with the increase in toner concentration. If the inter-sheet target toner concentration adjustment control is repeated at predetermined intervals during the print job, therefore, the target toner concentration is appropriately adjusted during the print job. As a result, the toner charge approaches and eventually stabilizes at a target value b in FIG. 8. If the toner charge thus stabilizes at the target value b, the development γ also stabilizes. Consequently, the adjustment of the target toner concentration becomes unnecessary, and the toner concentration also stabilizes, i.e., settles to a steady value. The toner concentration thus settling to a steady value and the image area ratio are related as illustrated in FIG. 9.

Figure 9:
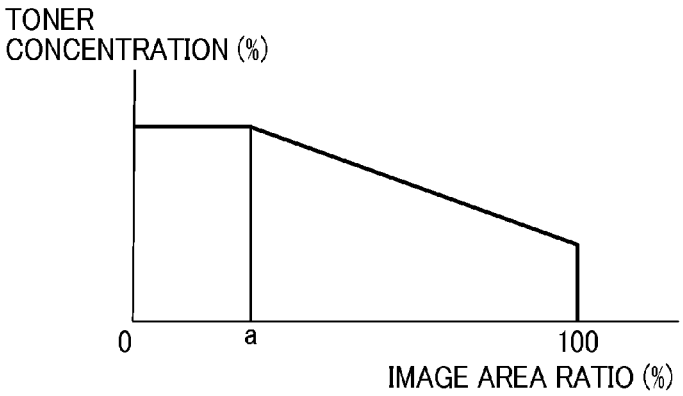
FIG. 9 is a graph illustrating the relationship between image area ratio and toner concentration settling to a steady value, which is obtained when the pre-job control is not executed but the inter-sheet target toner concentration adjustment control is executed.

FIG. 9 illustrates the relationship between the image area ratio of a print job of continuously outputting images having different image area ratios and the toner concentration which eventually settles to a steady value owing to the inter-sheet target toner concentration adjustment control repeated during the print job. If the toner concentration is adjusted as illustrated in FIG. 9 in accordance with the image area ratio of the print job from the beginning of the print job, therefore, the toner charge is stabilized at the target value b from the beginning of the print job. Accordingly, the development γ is stabilized from the beginning of the print job, irrespective of the image area ratio of the print job, and the image density is stabilized at the target image density.

As described above, however, the toner charge tends to be increased in accordance with the increase in mixing time, but be conversely reduced after the mixing time exceeds a certain period of time. This is because the toner deteriorates by a long-time mixing operation, and thereby is degraded in charging performance. If a relatively large amount of depleted toner affected by the long-time mixing operation is already present in the development unit 4 at the beginning of the print job, therefore, the toner charge may fail to reach the target value b during the print job, particularly in an early stage of the print job, and result in unstable image density, even if the toner concentration has been adjusted before the print job in accordance with the image area ratio of the print job. Further, if the print job is executed in such a state in which a relatively large amount of depleted toner is present in the development unit 4, the depleted toner may cause phenomena such as stain in a non-image area and toner scattering.

Figure 10:
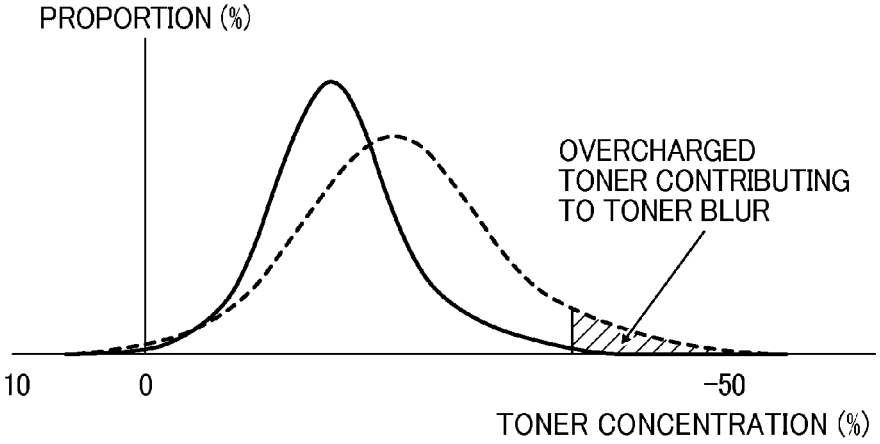
FIG. 10 is a graph illustrating a toner charge distribution in a development unit after a print job of images having a relatively low image area ratio.
Figure 11:
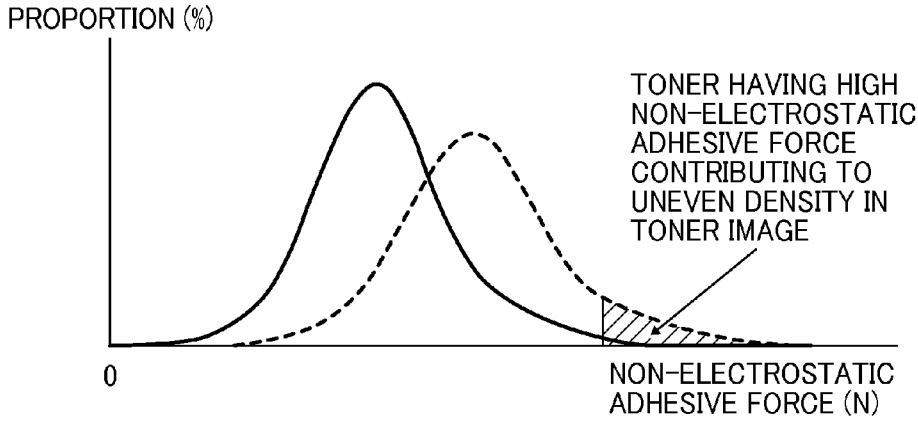
FIG. 11 is a graph illustrating a distribution of non-electrostatic adhesive force of toner in the development unit after a print job of images having a relatively low image area ratio.

Moreover, in the formation of images having a relatively low image area ratio, a relatively large amount of toner continuously affected by the mixing operation remains in the development unit 4, as a result of which a relatively high toner charge is obtained, as illustrated in FIG. 8. The toner charge distribution in this case is indicated by a broken line in FIG. 10, and a relatively large amount of overcharged toner is present, as indicated by hatching in FIG. 10. The presence of a relatively large amount of such overcharged toner results in toner blur in the transfer of the toner owing to the deviation of the transfer voltage from an optimal value. Further, in the formation of images having a relatively low image area ratio, the relatively large amount of toner continuously affected by the mixing operation and remaining in the development unit 4 results in an increase of depleted toner having relatively high non-electrostatic adhesive force, as indicated by hatching in FIG. 11. Such toner hinders uniform transfer of the image in the transfer process, causing uneven density in the toner image.

In a state in which a relatively large amount of such depleted toner, such as toner having an excessive charge or toner having relatively high non-electrostatic adhesive force, remains in the development unit 4, as in a case in which the images formed in the past have a relatively low image area ratio, the present embodiment executes, before or parallel to the toner concentration adjustment control preceding the print job, the forced toner consumption control of forcibly consuming the toner in the development unit 4. Accordingly, the depleted toner in the development unit 4 is reduced before the print job, thereby reducing the amount of depleted toner causing unstable image density, stain in a non-image area, toner scattering, toner blur, and uneven density in the toner image in an early stage of the print job, as indicated by solid lines in FIGS. 10 and 11.

Figure 12:
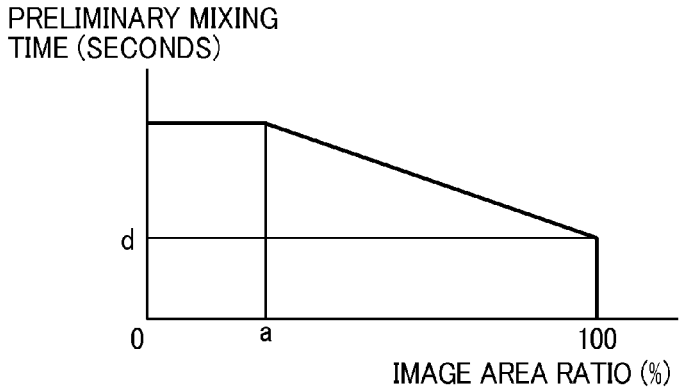
FIG. 12 is a graph illustrating an example of an optimal preliminary mixing time according to image area ratio.

If the preliminary mixing is performed, the preliminary mixing time is set such that the higher the adjusted toner concentration is (i.e., the lower the image area ratio is), the longer the preliminary mixing time is, as illustrated in FIG. 12.

Meanwhile, it has been found that, if the number of prints is increased in a print job of continuously printing images having a relatively low image area ratio, the image density is reduced, even if the toner concentration has been adjusted by the pre-job control executed before the print job. As a result of studies on this phenomenon, it has been confirmed that the phenomenon occurs in a case in which the images printed in the immediately preceding print job also have a relatively low image area ratio, e.g., a case in which the recording sheet is fed and discharged with no image formed thereon owing to the preliminary mixing performed in the development unit 4. The phenomenon is assumed to occur as follows.

That is, even if a relatively large amount of depleted toner is present in the development unit 4 owing to continuous printing of images having a relatively low image area ratio, the present embodiment is capable of reducing the depleted toner by executing the forced toner consumption control of the pre-job control. If the forced toner consumption control is excessively executed, however, normal toner is unnecessarily consumed, and the print job start time is unnecessarily delayed. It is therefore unrealistic to forcibly consume all of the depleted toner by executing the pre-job control, and thus a slight amount of depleted toner remains in the development unit 4 after the pre-job control. If a relatively large amount of depleted toner remains in the development unit 4 owing to the immediately preceding print job, therefore, it is difficult to sufficiently remove the depleted toner. The depleted toner is increased in non-electrostatic adhesive force, and deteriorates developer fluidity and thus development performance. It is therefore assumed that the unremoved depleted toner degrades development performance and causes the phenomenon of reduction in image density.

To address this phenomenon, the image area ratios of the images formed in a predetermined past period of time may be stored in an image formation history storage device of the controller 40, such as the RAM, and the specific target toner concentration (i.e., the toner concentration adjustment value in the previous toner consumption and supply control of the pre-job control) may be corrected in accordance with the average image area ratio of the stored image area ratios. For example, with the specific target toner concentration corrected, as illustrated in the following TABLE 1, in accordance with the average image area ratio A in the immediately preceding image forming period for forming a thousand images, no reduction in image density due to the increased number of prints has been observed. In the example of TABLE 1, the predetermined period for calculating the average image area ratio A is set to the image forming period for forming a thousand images. The optimal length of the predetermined period, however, varies depending on factors such as the toner or developer used in the image formation and the configuration of the development unit 4, such as developer containing capacity. It is therefore preferable to change the predetermined period as appropriate.

TABLE 1

| Average Image Area Ratio A (%) | Target Toner Concentration Correction Amount (%) |
|---|---|
| $A \geq 10$ | 0 |
| $5 \leq A < 10$ | +0.5 |
| $2.5 \leq A < 5$ | +1.0 |
| $0 \leq A < 2.5$ | +1.5 |

Meanwhile, it has been found that, if the number of prints is increased particularly in a print job of continuously printing images having a relatively high image area ratio, the image density is increased, even if the toner concentration has been adjusted by the pre-job control executed before the print job. As a result of studies on this phenomenon, it has been confirmed that the phenomenon occurs in a case in which the developer mixing time in the past is relatively long. The phenomenon is assumed to occur as follows.

If the developer mixing time is increased, as well as the toner in the development unit 4, the carrier also deteriorates. The present embodiment is capable of reducing the depleted toner by executing the forced toner consumption control of the pre-job control, but the deteriorated carrier continues to stay in the development unit 4 after the pre-job control. The carrier deteriorates by an additive separated from the toner and adhering to the carrier, and thereby is degraded in ability to frictionally charge the toner, causing a reduction in toner charge. It is assumed that the reduction in toner charge causes the phenomenon of increase in image density.

To address this phenomenon, the travel distance of the development sleeve 15 after the replacement of the developer may be cumulatively stored in an image formation history storage device of the controller 40, such as the RAM, as a carrier deterioration index value serving as an index of the degree of deterioration of the carrier in the development unit 4. Then, the specific target toner concentration (i.e., the toner concentration adjustment value in the previous toner consumption and supply control of the pre-job control) may be corrected in accordance with the travel distance of the development sleeve 15. For example, with the specific target toner concentration corrected, as illustrated in the following TABLE 2, in accordance with the travel distance D of the development sleeve 15 after the replacement of the developer, no increase in image density due to the increased number of prints has been observed over the life of the developer. If the toner bottles 39Y, 39M, 39C, and 39K store premixed toner mixed with carrier to extend the life of the developer, the carrier is also supplied to the development unit 4 to replace old carrier when the toner is supplied to the development unit 4. In this case, therefore, the travel distance of the development sleeve 15 with the replacement of carrier taken into account is used as the carrier deterioration index value.

TABLE 2

| Travel Distance D of Development Sleeve after Replacement of Developer (km) | Target Toner Concentration Correction Amount (%) |
|---|---|
| $D \geq 300$ | −1.5 |
| $200 \leq D < 300$ | −1.0 |
| $100 \leq D < 200$ | −0.5 |
| $0 \leq D < 100$ | 0 |

Figure 13:
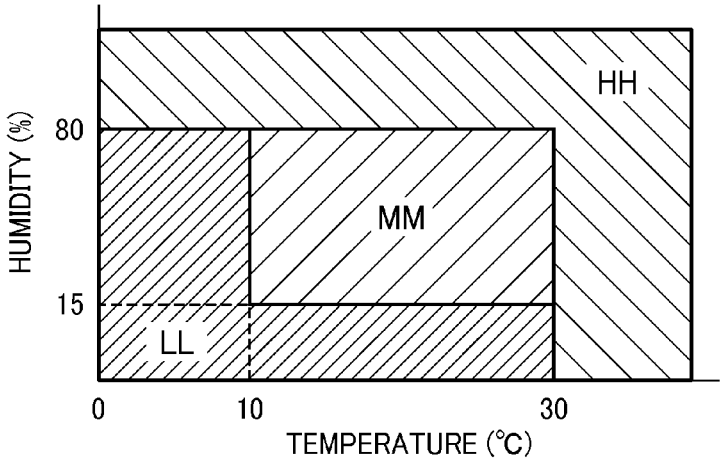
FIG. 13 is an explanatory diagram illustrating divisions of a low-temperature, low-humidity environment, a medium-temperature, medium-humidity environment, and a high-temperature, high-humidity environment.

Further, the toner charge in the developer of the development unit 4 is normally affected by temperature and humidity. That is, the toner charge is reduced in a high-temperature, high-humidity environment, and is increased in a low-temperature, low-humidity environment. Accordingly, therefore, the humidity and temperature of the environment in which the printer 1 is situated may each be detected by a detector, and the specific target toner concentration (i.e., the toner concentration adjustment value in the previous toner consumption and supply control of the pre-job control) may be corrected in accordance with the detection result. For example, with the specific target toner concentration corrected, as illustrated in the following TABLE 3, in accordance with divisions of the environment of the printer 1 according to humidity (%) and temperature (° C.), as illustrated in FIG. 13, image outputs with a stable image density not depending on the environment have been observed. In TABLE 3, HH, MM, and LL represent a high-temperature, high-humidity environment, a medium-temperature, medium-humidity environment, and a low-temperature, low-humidity environment, respectively. TABLE 3 illustrates an example, in which the correction is performed in accordance with three divisions of the environment. Alternatively, the environment may be divided into a larger number of divisions, and the target toner concentration correction amount may be corrected in accordance with such divisions.

TABLE 3

| Divisions of Environment | Target Toner Concentration Correction Amount (%) |
|---|---|
| HH | −1.0 |
| MM | 0 |
| LL | +1.0 |

Further, the toner charge in the developer of the development unit 4 is normally reduced in accordance with the retention time of the developer. Accordingly, therefore, the retention time, for which the developer is left unused with no image informing operation performed after the previous print job, may be stored in a retention time storage device of the controller 40, such as the RAM. Then, whether or not to perform the preliminary mixing after the previous toner consumption and supply control of the pre-job control and the preliminary mixing time of the preliminary mixing may be determined in accordance with the retention time. For example, with the preliminary mixing time adjusted in accordance with the retention time T, as illustrated in the following TABLE 4, image outputs with a stable image density not depending on the retention time have been observed. In the example of TABLE 4, the preliminary mixing time is set in stages for the retention time T. Alternatively, the preliminary mixing time may be continuously set for the retention time T.

TABLE 4

| Retention Time T (hours) | Preliminary Mixing Time (seconds) |
|---|---|
| $T \geq 6$ | 60 |
| $3 \leq T < 6$ | 30 |
| $1 \leq T < 3$ | 10 |
| $0 \leq T < 1$ | 0 |

It is to be noted that the present invention is not limited to the above-described embodiments. For example, the development unit 4 serving as the development device, the toner concentration sensor 14, and the toner supply device may each have another appropriate configuration. The configuration and location of the toner adhesion amount sensor 41 may also be modified as appropriate, and the toner adhesion amount on the photoconductor drum 10 may be directly detected. The process units 2 serving as the image forming devices and the exposure unit 11 of the printer 1 serving as the image forming apparatus may also be arbitrarily configured.

Further, the present invention is applicable not only to the full-color image forming apparatus but also to a monochrome image forming apparatus and a color image forming apparatus which forms an image of a plurality of colors. The image forming apparatus is not limited to the printer, and may be a copier, a facsimile machine, or a multifunction machine combining several of the functions of these apparatuses.

As described above, the above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. An image forming apparatus comprising:

a latent image carrier configured to carry a latent image formed thereon in accordance with an input of an image forming job;

a development device configured to develop the latent image with a two-component developer including toner and carrier, to thereby form a toner image to be transferred to a recording medium;

a toner supply device configured to supply, at predetermined intervals, the development device with toner by an amount consumed in the development of the image;

a forced toner consumption controller configured to execute a forced toner consumption control of causing the toner in the development device to adhere to a non-image area in a surface of the latent image carrier and be forcibly consumed;

a toner supply controller configured to execute a toner supply control of causing the toner supply device to supply the development device with toner to make a toner concentration in the developer of the development device approach a specific target toner concentration; and a pre-job controller configured to, upon receipt of the input of the image forming job, and before the start of image formation of the image forming job, acquire a toner consumption index value serving as an index of toner consumption per image to be formed by the input image forming job, determine a specific target image density based on the acquired toner consumption index value, and execute a previous toner consumption and supply control and then a previous image density adjustment control, the previous toner consumption and supply control causing the forced toner consumption controller to execute the forced toner consumption control, and causing the toner supply controller to execute the toner supply control to make the toner concentration in the developer of the development device subjected to the forced toner consumption control approach the specific target toner concentration, and the previous image density adjustment control adjusting one or more image forming conditions to make an image density after the previous toner consumption and supply control approach the specific target image density.

2. The image forming apparatus according to claim 1, further comprising:

an image density adjustment controller configured to execute, at predetermined intervals during a continuous image forming job of continuously forming images, an image density adjustment control of adjusting one or more image forming conditions including the target toner concentration, to make the image density approach the specific target image density, wherein the pre-job controller determines the specific target toner concentration as a value of the target toner concentration adjusted within a specified range by the image density adjustment control repeated at the predetermined intervals in a continuous image forming job of continuously forming images corresponding to the acquired toner consumption index value.

3. The image forming apparatus according to claim 1, further comprising:

a toner adhesion amount detector, wherein the pre-job controller executes the previous image density adjustment control to form a latent pattern for image density adjustment on the surface of the latent image carrier, cause the development device to develop the latent pattern and thereby form the toner pattern, cause the toner adhesion amount detector to detect the toner amount adhering to the toner pattern, and adjust one or more image forming conditions based on the detected toner amount.

4. The image forming apparatus according to claim 1, wherein the pre-job controller causes the developer in the development device to be mixed after the previous toner consumption and supply control and before the previous image density adjustment control.

5. The image forming apparatus according to claim 1, wherein the pre-job controller executes the toner supply control while executing the forced toner consumption control.

6. The image forming apparatus according to claim 1 further comprising:

an input device configured to receive an instruction from an operator; and a selector configured to select, in accordance with the instruction received by the input device, whether or not to cause the pre-job controller to execute the previous toner consumption and supply control and the previous image density adjustment control.

7. The image forming apparatus according to claim 1, further comprising:

an image formation history storage device configured to store a toner consumption index value serving as an index of toner consumption per image formed in a predetermined past period of time, wherein the pre-job controller determines, based on the acquired toner consumption index value and the toner consumption index value stored in the image formation history storage device, the specific target image density to be used in the previous toner consumption and supply control.

8. The image forming apparatus according to claim 1, further comprising:

a carrier deterioration index value storage device configured to store a carrier deterioration index value serving as an index of the degree of deterioration of the carrier in the development device, wherein the pre-job controller determines, based on the acquired toner consumption index value and the carrier deterioration index value stored in the carrier deterioration index value storage device, the specific target image density to be used in the previous toner consumption and supply control.

9. The image forming apparatus according to claim 1, further comprising:

a detector configured to detect at least one of temperature and humidity, wherein the pre-job controller determines, based on the acquired toner consumption index value and a detection result obtained by the detector, the specific target image density to be used in the previous toner consumption and supply control.

10. The image forming apparatus according to claim 1, further comprising:

a retention time storage device configured to store a retention time for which the developer is left unused with no image forming operation performed after a previous image forming job, wherein the pre-job controller determines, based on the acquired toner consumption index value and the retention time stored in the retention time storage device, the specific target image density to be used in the previous toner consumption and supply control.

11. A toner supply control method for an image forming apparatus, the image forming apparatus comprising:

a latent image carrier configured to carry a latent image formed thereon in accordance with an input of an image forming job;

a development device configured to develop the latent image with a two-component developer including toner and carrier, to thereby form a toner image to be transferred to a recording medium; and a toner supply device configured to supply, at predetermined intervals, the development device with toner by an amount consumed in the development of the image, the method comprising:

receiving the input of the image forming job;

acquiring a toner consumption index value serving as an index of toner consumption per image to be formed by the input image forming job;

determining a specific target image density based on the acquired toner consumption index value;

executing a forced toner consumption control of causing the toner in the development device to adhere to a non-image area in a surface of the latent image carrier and be forcibly consumed;

executing a toner supply control of causing the toner supply device to supply the development device with toner to make a toner concentration in the developer of the development device subjected to the forced toner consumption control approach a specific target toner concentration;

executing a previous image density adjustment control of adjusting one or more image forming conditions to make an image density after the forced toner consumption control and the toner supply control approach the specific target image density; and performing image formation of the image forming job.

* * * * *